US007499068B2

(12) United States Patent
Tai et al.

(10) Patent No.: US 7,499,068 B2
(45) Date of Patent: Mar. 3, 2009

(54) APPARATUS AND METHOD FOR MULTICHANNEL SEQUENCE TRANSMISSION AND CONTROL

(75) Inventors: Feng-Yi Tai, Chung-Ho (TW); Kuo-Jen Lien, Chung-Ho (TW)

(73) Assignee: Godex International Co., Ltd., Chung-Ho (TW)

( * ) Notice: Subject to any disclaimer, the term of this patent is extended or adjusted under 35 U.S.C. 154(b) by 512 days.

(21) Appl. No.: 11/196,058

(22) Filed: Aug. 3, 2005

(65) Prior Publication Data

US 2007/0030328 A1 Feb. 8, 2007

(51) Int. Cl.
*B41J 2/325* (2006.01)

(52) U.S. Cl. ..... 347/172; 347/171; 347/184

(58) Field of Classification Search ..... 347/171, 347/172, 183, 184, 5, 9, 194
See application file for complete search history.

(56) References Cited

U.S. PATENT DOCUMENTS 4,630,068 A * 12/1986 Ims ..... 347/184
4,806,949 A * 2/1989 Onuma et al. ..... 347/183
5,142,302 A * 8/1992 Kano ..... 347/172

* cited by examiner

*Primary Examiner*—Lam S Nguyen

(57) ABSTRACT

An apparatus and a method for multichannel sequence transmission and control comprises a DMA generator, a bus interface, a data generator, a control unit, and a strobe signal generator. The DMA generator is coupled to the bus interface and the data generator to operate with the control unit and the strobe signal generator. A step of initial setting is an external microcontroller generates a TPH shift clock and a TPH latch signal needed by a print head. A step of transmitting data is the DMA generator transmits a printing data to the data generator for being buffered and moved to a latch register in the print head and then the strobe signal generator provides the signal period of the respective strobe signal and the time spacing between the respective strobe signal to allow a multiplexer outputting the actual strobe signals, which are combined from the virtual strobe signals, to the print head. A step of heating the print head is the print head prints the assigned data until the strobe signals ending.

11 Claims, 6 Drawing Sheets

APPARATUS AND METHOD FOR MULTICHANNEL SEQUENCE TRANSMISSION AND CONTROL

BACKGROUND OF THE INVENTION

1. Field of the Invention

The present invention relates to an apparatus and a method for multichannel sequence transmission and control, and more particularly to a control of data transmission and printing for a thermal transfer print head or a thermal print head (TPH).

2. Description of the Prior Art

Due to population of the digital image products and improvements of the printing technique related products and inks, users are easy to print out a photograph with the ordinary printer and the print quality is not worse than the traditional developed photograph. The color printers available in the market are classified into the color inkjet printer, the color laser printer, and thermal transfer printer. The printout of the inkjet printer is easy to be more or less spread with the ink to blur the image printed on the paper. Furthermore, the printing speed of the inkjet printer is slow. The printing quality and speed of the laser printer are better than the inkjet printer, but the price of laser printer is too high for general users. The printing speed of thermal transfer printer is faster, and the printout of the thermal transfer printer has a good printed quality and a water-resistant coating. Moreover, the cost of the thermal transfer printer is cheaper. Therefore, the thermal transfer printer has become the mainstream in the printer market gradually.

The data-transmission and printing method of the conventional thermal transfer printer will be described in the following. First, the contents desired to print, comprising words, and pictures, are transmitted in column/row-based transmission method controlled by an external microcontroller, such as CPU or MCU, to a shift register in a print head sequentially. Next, the column/row-based contents in the shift register are transmitted to and stored in the latch register via a latch signal set by a control unit. Plural heating units, which correspond to the latch register, are enabled by strobe signals generated by a strobe signal generator to heat the respective color ribbon for the surface of a printed media, such as a paper or photographic paper, being printed with a predetermined column/row content through the heated ribbon. And then, the printed paper is moved by a rotating axle to the next line to complete the printing of the current predetermined column/row content. The printing process is performed repeatedly till the entire picture being printed onto the surface of the printed media. However, as the data-transmission and printing method described above, the data-transmission and is directly controlled by the external microcontroller. Therefore, the data transmission, the printing speed and the printing quality are directly related to the load of the data process of the microcontroller.

In addition, the print head, which is one of key components of the thermal transfer printer mentioned above, employs plural heating units therein to heat the color ribbon for sublimating dyes in the color ribbon and generating an image on a surface of the printed media. The respective heating unit, which is a thermo-sensitive resistor, heats up gradually when the current flows therein and cools down gradually when the current stops flowing. Therefore, the preceding feature of the respective heating unit is capable of heating the color ribbon to perform the printing operation.

The ribbon applied in the thermal transfer printer is a stable solid state at the room temperature and is sublimated to vaporize when the temperature is higher than a preset critical temperature, wherein the ribbon comprises a plurality of color regions arranged sequentially and each of the color regions has a color dye different from each other. The amount of the dye transferred onto the printed media is based on a vaporized duration of the dye, and the more the dye is, the deeper the gray level is. Hence, to achieve a preferable printing quality, the ribbon has to be heated up to a temperature above the critical temperature for a period of time. Unfortunately, the working temperature of the heating unit has an upper limit, and it can be seen in FIG. 1 that the temperature of the heating unit rises rapidly at the initial heating stage and the heating unit may be damaged when the temperature is over the upper limit.

SUMMARY OF THE INVENTION

A main objective of the present invention is to provide an apparatus and a method for multichannel sequence transmission and control for a thermal transfer printer or a thermal printer.

Another objective of the present invention is to provide an apparatus and a method for multichannel sequence transmission and control, in which a DMA generator is coupled to a bus interface and a data generator. Therefore, the designated printing data is generated and is directly transmitted via memory to decrease the work load of the microcontroller while controlling the print head such that the operation time of the external processor can be saved greatly and the printing quality and speed can be enhanced significantly.

A further objective of the present invention is to provide an apparatus and a method for multichannel sequence transmission and control, in which the heating units perform the heating repeatedly in a temperature range between an upper heating temperature limit and a lower cooling temperature close to a vaporizing temperature of the dyes in the color ribbon to form a control of the print head for cutting the heating pulse of the heating units such that the life span of the print head can be authentically extended and the power consumption can be reduced effectively.

Hence, the present invention discloses an apparatus for multichannel sequence transmission and control, which is coupled between an external microcontroller and a print head. The apparatus comprises a bus interface, a DMA generator, a control unit, a strobe signal generator, and a data generator. The bus interface is coupled to the external microcontroller to obtain an instruction and information and transmits the instruction and the information to each unit which is coupled to the bus interface. The DMA generator requests a service of a DMA controller in the external microcontroller automatically and operates a DMA signal coming from the DMA controller according to a state of the data buffer region in the data generator, and then generates an event interrupt signal corresponding to an interrupt controller in the external microcontroller interrupting controlling a buffer in the data buffer region. The control unit generates a TPH shift clock and a TPH latch signal, which are received in a shift register and a latch register in the print head respectively, for controlling a data transmission frequency of the print head according to an external frequency sent to the external microcontroller. Further, the TPH latch signal can be generated manually or automatically, and the control unit can generate a corresponding interrupt signal after the TPH latch signal ending. The strobe signal generator includes at least a multiplexer and plural different virtual strobe signals, which are set in accordance with needs, such that the connections between the virtual strobe signals and the actual strobe signals can be arranged to generate different sequence strobe signals for outputting to at least an input pin of the print head, and generates plural continuous and different strobe signals for controlling the heating operation of the print head. The data generator temporarily stores an assigned printing data written by the external microcontroller or the DMA generator, and transmits the printing data to the latch register of the print head based on the TPH latch signal for being used during printing.

The present invention also discloses a method for multichannel sequence transmission and control applied with an apparatus comprising a DMA generator, a bus interface, a data generator, a control unit, and a strobe signal generator. The method comprises:

a step of initial setting in which an external microcontroller controls the control unit to generate a TPH shift clock and a TPH latch signal necessary for a print head;

a step of transmitting data in which the DMA generator transmits an assigned printing data to the data generator for being buffered and moved to a latch register in the print head according to the TPH latch signal; and a step of heating the print head in which the strobe signal generator generates a plurality of strobe signals with a signal period of the respective strobe signal and a time spacing between the respective strobe signal being preset for a multiplexer outputting combinations of the respective strobe signal to the print head according to the preset signal period and the time spacing, the heating units are enabled to heat the color ribbon before the print head performing the printing operation, and the assigned printing data is printed out completely until the respective strobe signal ending.

In the preferred embodiment of the present invention, the TPH shift clock generated by the control unit is a pulse signal formed with the external frequency coming via the external microcontroller being frequency-divided with data preset in the register of the control unit to shift the data from the data generator into the shift register of the print head.

In the preferred embodiment of the present invention, the signal period of the respective strobe signal generated by the strobe signal generator and the time spacing between the respective strobe signal can be set according to different needs.

In the preferred embodiment of the present invention, the data generator has a first-in-first-out data buffer region coupled to the data pins of the print head to transmit printing data in accordance with the sequence of the stored data.

DESCRIPTION OF THE PREFERRED EMBODIMENT

Figure 1:
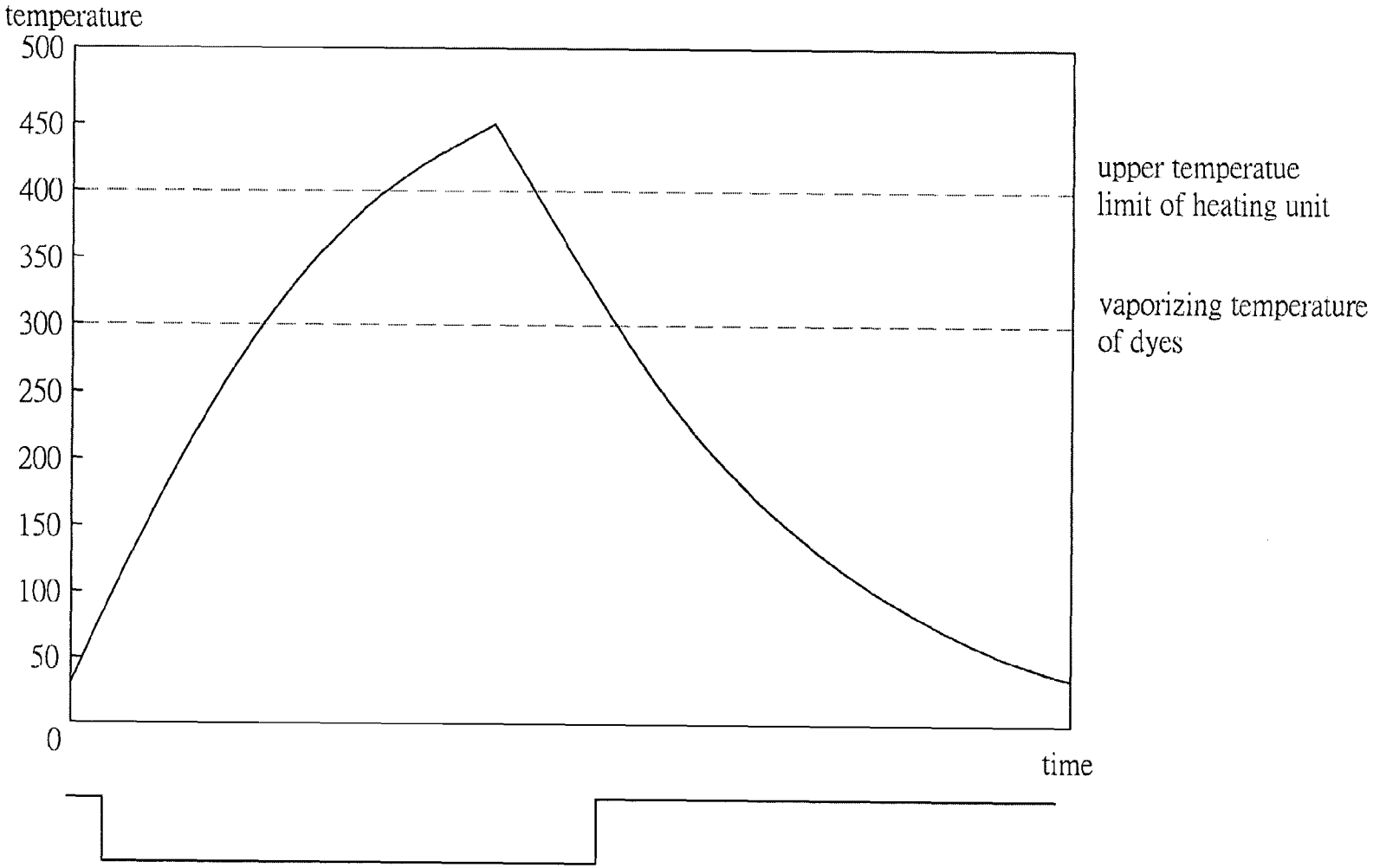
Fig. 1(Prior Art)
FIG. 1 is a heating curve diagram of a heating unit in the conventional arts.
Figure 2:
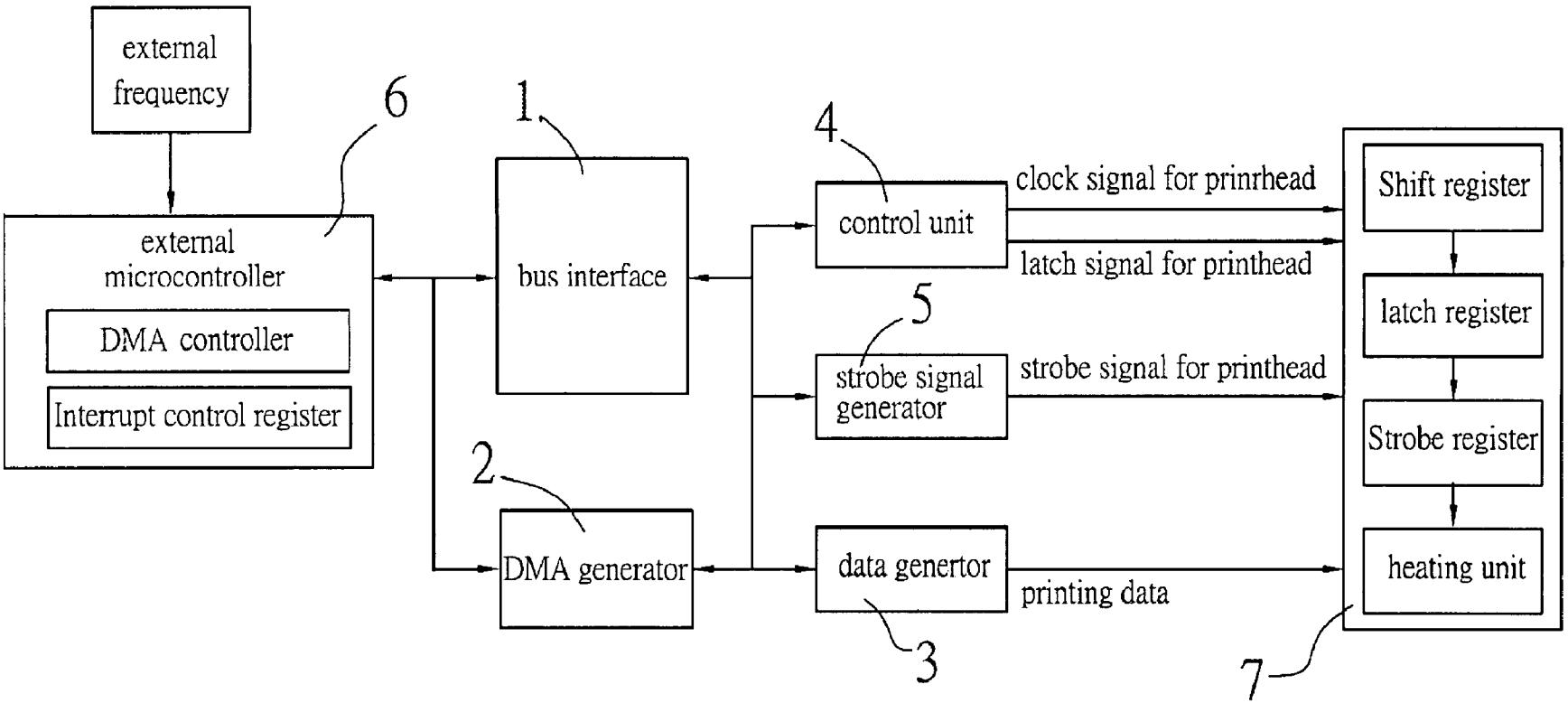
FIG. 2 is a structural block of the present invention.

Referring to FIG. 2, it is a structural block of an apparatus and a method for multichannel sequence transmission and control in the present invention. As shows in FIG. 2, the apparatus comprises a bus interface 1, a DMA generator 2, a data generator 3, a control unit 4, and a strobe signal generator 5. The bus interface 1 is coupled to an external microcontroller 6 to obtain a control instruction for printing. The data generator 3, the control unit 4 and the strobe signal generator 5 have a signal output end respectively to couple with a print head 7 of a printer for transmitting printing data and controlling the printing action. Therefore, the multichannel sequence transmission and control apparatus with a high printing efficiency and a simple control of dividing heating pulses is formed to secure a long service life and decrease the power consumption. Hence, the apparatus of the present invention is suitable for any thermal transfer printers or thermal printers.

At least one input pin of the bus interface 1 is coupled to the external microcontroller 6 such that an instruction and information from the external microcontroller 6 can be transmitted to the DMA generator 2, the data generator 3 and a strobe signal generator 4, which are coupled to the bus interface 1, to perform an operation corresponding to the instruction and information.

The DMA generator 2 requests a DMA controller in the external microcontroller to perform a DMA service according to a state of first-in-first-out data buffer region (not shown) of the data generator, and operates DMA acknowledge handshake signal generated by the DMA controller. In addition, the DMA controller can generate an event interrupt signal corresponding to an instruction of an interrupt register in the microcontroller for interrupting control of the data buffer region of the data generator.

As it was mentioned previously, the data generator 3 has a first-in-first-out data buffer region, which temporally stores a designated data written by the external microcontroller 6 or the DMA controller 2. The designated data is transmitted to a latch register of the print head 7 according to a control instruction of a TPH latch signal generated by the control unit 4. The first-in-first-out data buffer region is coupled to the data pin of the print head 7 to transmit the printing data based on the stored data sequence.

The control unit 4 generates a TPH shift clock and a TPH latch signal for controlling a data transmission frequency of the print head according to an external frequency transmitted by the external microcontroller 6. The TPH shift clock is a pulse signal formed with the external frequency being frequency-divided with the preset data in the register of the control unit 4 to shift data into shift register in print head 7.

The strobe signal generator 5 generates plural strobe signals required at the time of the print head 7 being heated up. The strobe signals can be combined as plural continuous strobe signals different from each other for controlling the operation of heating the print head 7 and producing corresponding interrupt signals.

Figure 3:
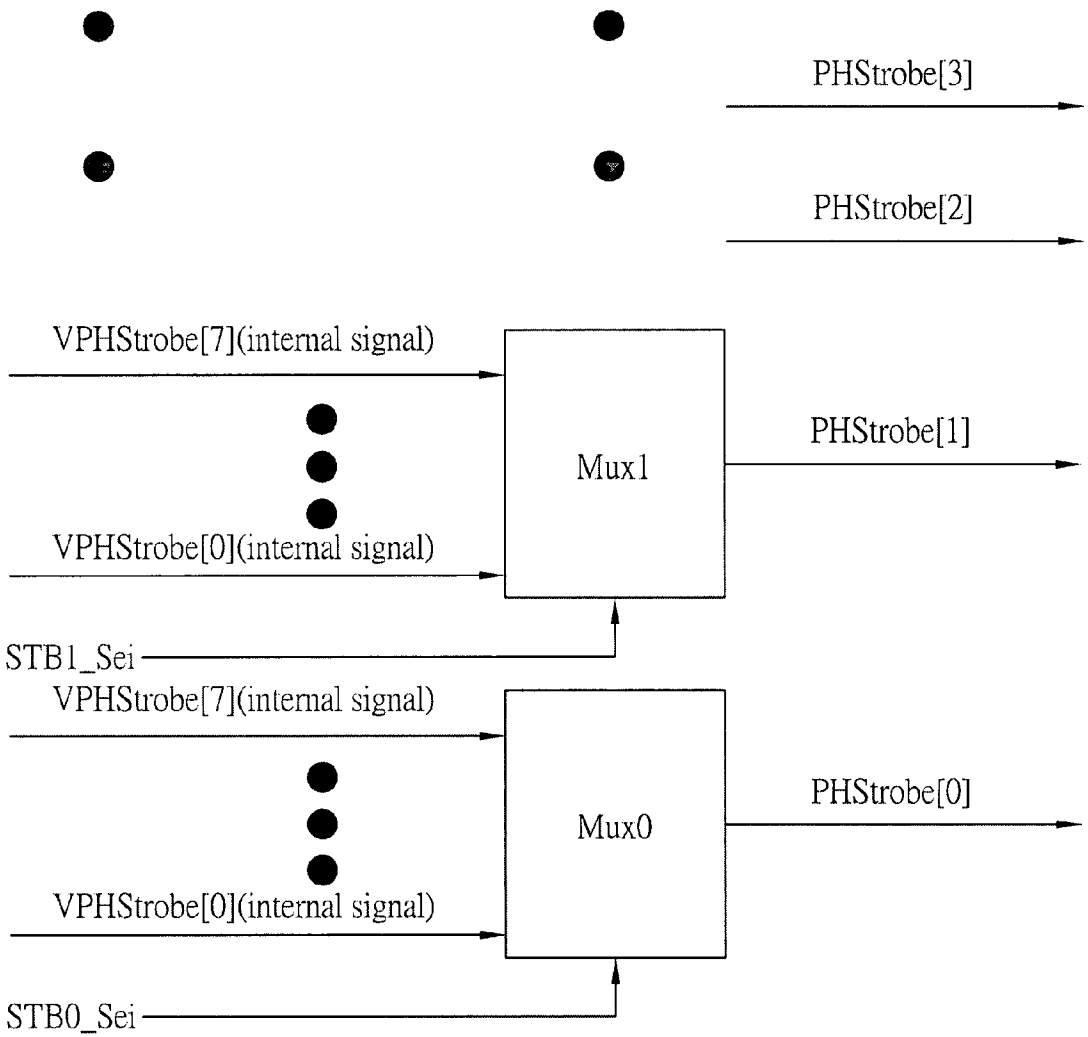
FIG. 3 is an assembly diagram of a multiplexer in a strobe signal generator of the present invention.

In the preferred embodiment of the present invention, the strobe signal generator 5 generates plural different virtual strobe signals first according to various demands, and then multiplexers the virtual strobe signals as the same or different numbers of the actually output strobe signals corresponding to the virtual strobe signals. Each of the virtual strobe signals has a signal period and a time spacing is formed between the respective strobe signal. The signal period and the time spacing can be set according to various demands. A multiplexer 8 is disposed between the virtual strobe signals and the actual strobe signals as shown in FIG. 3. In this way, the virtual strobe signals can be arranged in different combinations to correspond to the actual strobe signals such that the heating time of the respective heating unit of the print head 7 can be set to have a heating time with different flexible adjustments and changes.

Figure 4:
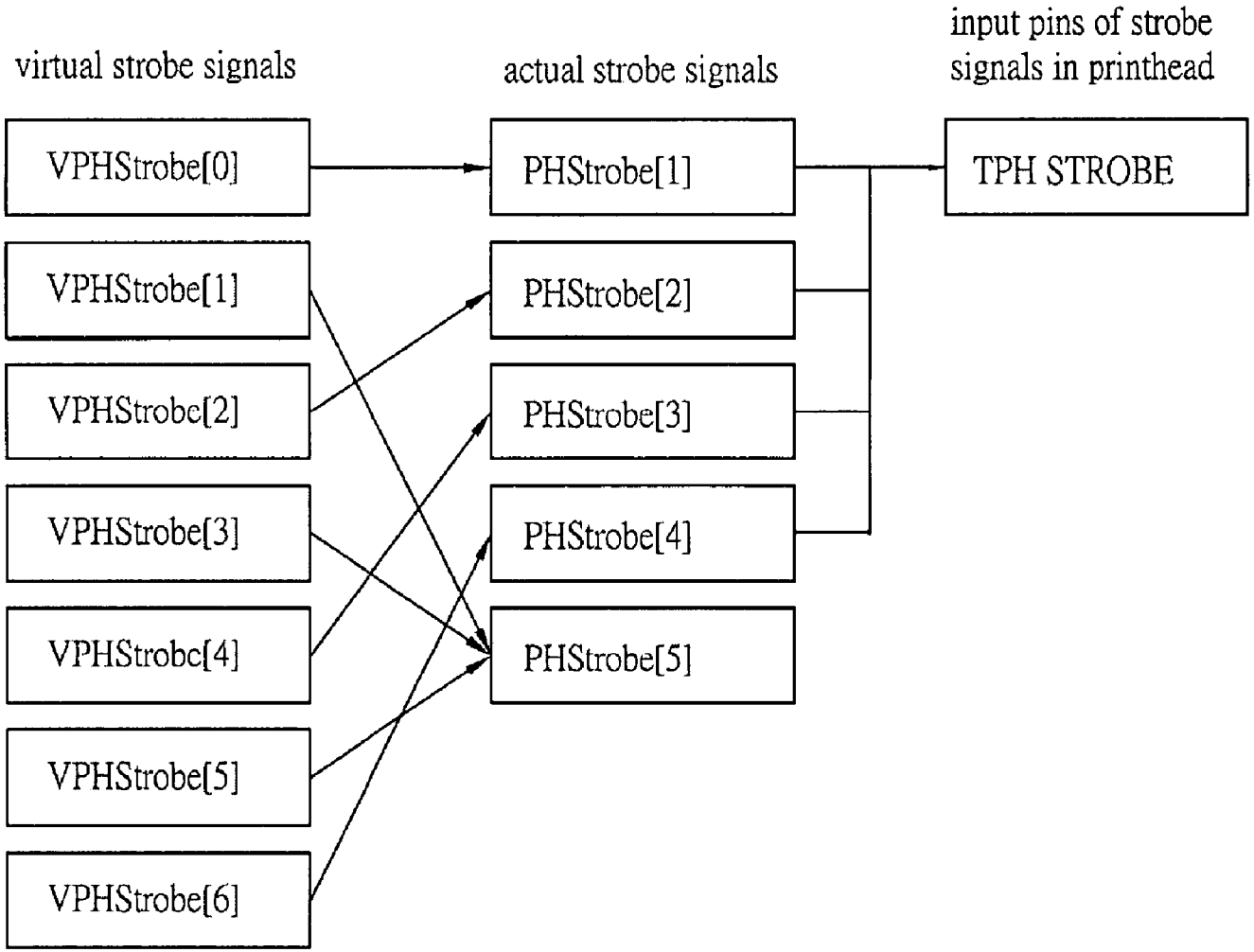
FIG. 4 is a connecting diagram among a strobe signal register, a virtual strobe signal register, and a print head in the present invention.

That is to say, the present invention can control the output of the actual strobe signals for controlling the heating time of the heating units via the combination of the virtual strobe signals and the actual strobe signals. As shown in FIG. 4, there are seven virtual strobe signals VPHStrobe[0]~VPHStrobe[6], and five actual strobe signals PHStrobe[1]~PHStrobe[5]. The actual five strobe signals PHStrobe[1]~PHStrobe[5] are coupled to the same input pin of strobe signal in the print head 7. The virtual strobe signals VPHStrobe[0], [2], [4] and [6] are respectively connected to the actual strobe signals PHStrobe[1]~PHStrobe[4], and the virtual strobe signals VPHStrobe[1], [3], and [5] are connected to the actual strobe signal PHStrobe[5]. The time spacings between the virtual strobe signals VPHStrobe[0]~VPHStrobe[6] in the register are 5, 1, 5, 1, 5, 1, 5. The heating process is automatically performed four times, and is suspended for 1 time unit after heating for 5 time units. Therefore, it is easy to divide the heating time into parts to form heating pulses for controlling the heating process and obtaining versatile heating effects. The service life is extended and the power consumption is decreased. Moreover, the heating process is automatically controlled without occupying the additional operation time and increasing the work load of the microcontroller.

The present invention is suitable for any thermal transfer printers or thermal printers to perform multichannel sequence transmission and control. The apparatus of the present invention mainly employs multichannel sequence transmission and control in cooperation with the DMA generator 2 transmitting the assigned printing data directly to reduce the work load of the external microcontroller 6 for promoting the printing speed. Further, the heating pulse is divided into parts by means of setting the strobe signal generator 5 to obtain versatile heating control effects for extending the service life of the print head 7 and decreasing the power consumption.

The method for multichannel sequence transmission and control according to the present invention will be described below.

In a step of initial setting: The external microcontroller 6 controls the control unit 4 via the bus interface 1 to generate the TPH shift clock and the TPH latch signal for the print head 7. The step of initial setting is only performed once after the apparatus is turned on, and the apparatus generates a frequency-divided signal needed by the print head 7 according to the frequency signal provided by the external microcontroller 6.

Next, in a step of transmitting data: A data address and a data length of the oncoming printed line are designated and the DMA generator 2 is enabled; then, the DMA generator 2 automatically transmits the printing data to the first-in-first-out buffer region of the data generator 3, and further, the control unit 4 automatically generates the shift clock and the TPH latch signal and transmits the data stored in the first-in-first-out buffer region to the latch register of the print head 7 at an appropriate time, that is, the time of the print head 7 accepting the latch signal and moving the printing data to the latch register.

In a step of heating the print head: The signal period of each strobe signal and the time spacing between the respective strobe signal in the strobe signal generator 5 are preset and a parameter of the respective multiplexer 8 is preset according to the actual design of the print head 7; at least a multiplexer 8 combines and outputs the strobe signals generated by the strobe signal generator 5 to the print head 7; the heating units are enabled and the strobe signal generator 5 generates the strobe signals corresponding to the respective required signal period and the time spacing to control the heating units to heat the color ribbon to the sublimate temperature of the color dyes; and the heating units perform printing operation of the printing data unit the strobe signals ending.

The control unit 4 generates the TPH shift clock and latch signal to transmit the data to the latch register of the print head 7. If the print head is still in the state of the current printing action, the next data transmission done by the latch signal is automatically delayed until the heating of the print head 7 for the current printing is finished.

Figure 5:
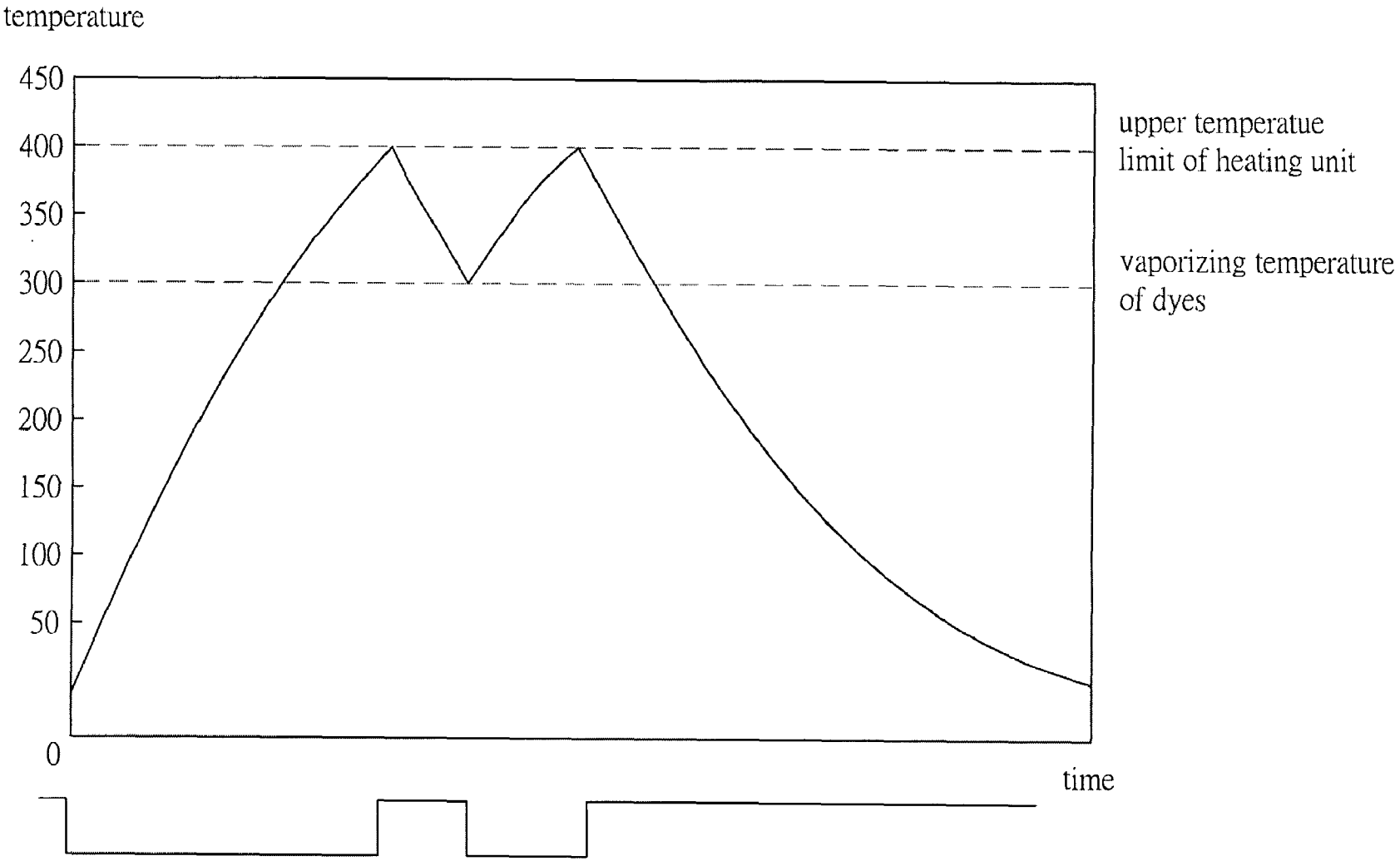
FIG. 5 is a heating curve diagram with heating pulses in a preferred embodiment of the present invention.
Figure 6:
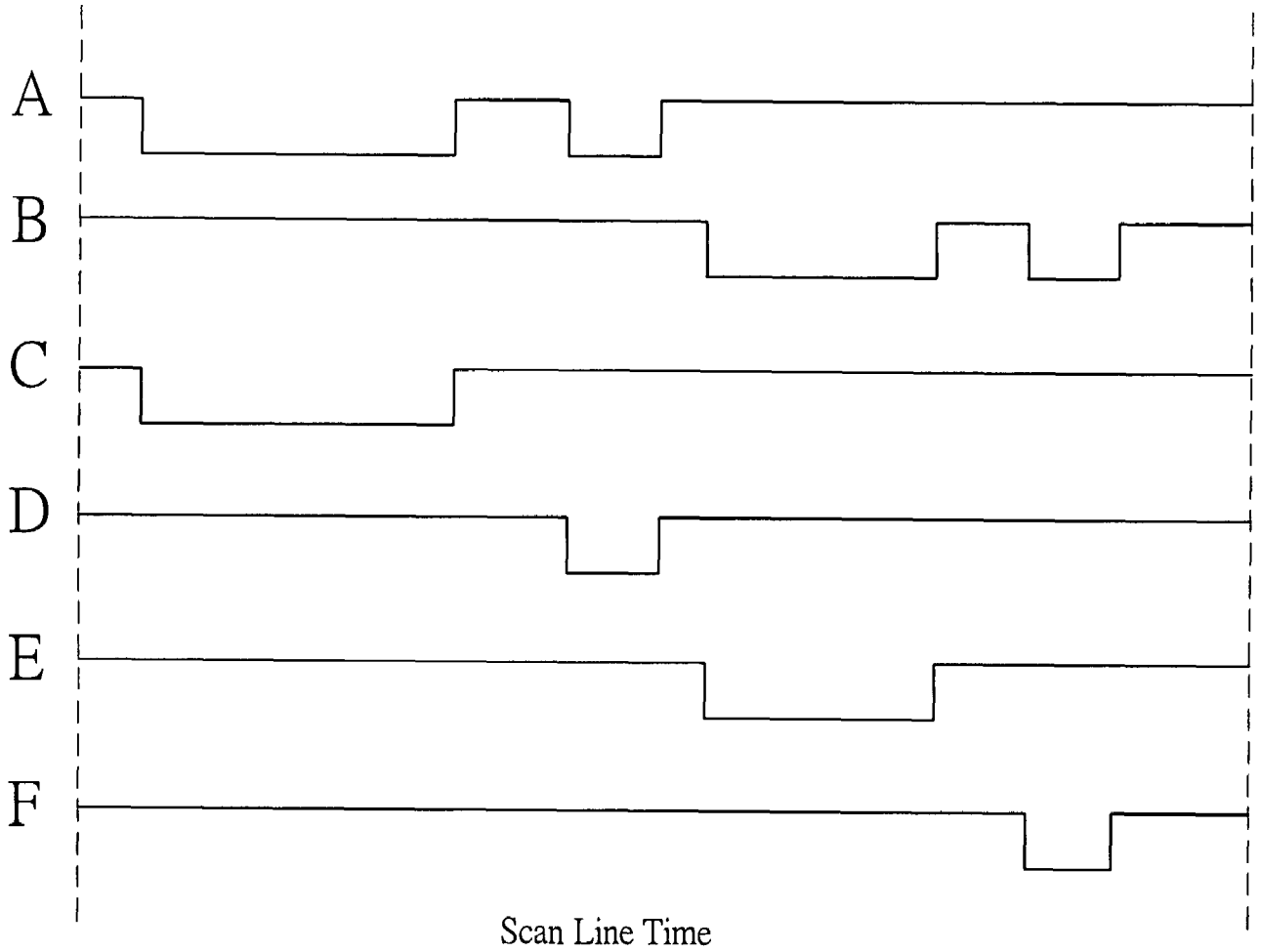
FIG. 6 is a diagram of heating pulses in the preferred embodiment of the present invention.

Referring to FIGS. 5 and 6, a heating curve diagram corresponding to the heating pulses and a diagram of heating pulses for an apparatus and a method for multichannel sequence transmission and control according to the present invention being applied to the thermal transfer printer are illustrated. As shown in FIGS. 5 and 6, the print head of the thermal transfer printer is provided with 1344 heating units and two input pins for the strobe signals. The strobe signal A controls the $1^{st}$~$576^{th}$ heating units, and the strobe signal B controls the $577^{th}$~$1344^{th}$ heating units. In this embodiment, the waveform of the pulse, as shown in FIG. 5, is disposed at the bottom of the diagram and heating curve shows that the temperature keeps between the upper temperature limit and the vaporizing temperature of dyes with the heating units having plural times of heating and cooling such that the heating pulse is divided into control parts. Therefore, the versatile heating effects are obtained for extending the service life of the print head and decreasing the power consumption needed.

In addition, FIG. 6 shows the required heating pulses in the embodiment of the present invention. The strobe signal A of the print head has to generate the heating pulse line A, and the strobe signal B of the print head has to generate the heating pulse line B. For generating the two heating pulses, the strobe signal generator 5 is provided to generate four heating pulses, which are shown with lines C, D, E, and F. Then, the multiplexer 8 is provided to output the strobe signals C and D into the input pin of the strobe signal A in the print head 7 and to output the strobe signals E and F into the input pin of the strobe signal B in the print head 7. In this way, the heating pulses A, B to perform the desired heating action of the heating units can be obtained successfully.

Although specific embodiments have been illustrated and described, it will be obvious to those skilled in the art that various modifications may be made without departing from what is intended to be limited solely by the appended claims.

What is claimed is:

1. An apparatus for multichannel sequence transmission and control for being applied to a thermal transfer print head or a thermal print head and coupled to an external microcontroller, which generates an instruction and information and provides an external frequency and said print head, which provides at least an input pin and a latch register, comprising:

a bus interface coupled to said external microcontroller to obtain said instruction and information;

a DMA generator being coupled to said bus interface to receive said instruction and information, requesting a DMA controller in said external microcontroller to perform a control of data transmission, handling a signal of DMA acknowledge handshake generated by said DMA controller, and generating an event interrupt signal according to an order from an interrupt control register in said external microcontroller;

a control unit connecting with said DMA generator and said print head respectively and generating a TPH shift clock and TPH latch signal needed by said print head according to said external frequency a strobe signal generator being coupled to said DMA generator and said print head, providing at least a multiplexer and generating a plurality of virtual strobe signals, wherein said multiplexer is capable of combining said virtual strobe signals as a plurality of continuous and different actual strobe signals to output to said input pin to control a heating operation of said print head; and a data generator being coupled to said DMA generator and said print head, providing a data buffer region temporarily store a printing data written by said external microcontroller or said DMA generator, transmitting said printing data to said latch register in said print head according to said TPH latch signal and a state of said data buffer region offers said DMA generator to request said DMA controller to perform said control of data transmission.

2. The apparatus according to claim 1, wherein said TPH shift clock is a pulse signal obtained by means of said external frequency being frequency-divided with a data set in a shift register in said print head.

3. The apparatus according to claim 1, wherein a signal period of each of said virtual strobe signals and a time spacing between the respective strobe signal strobe are set according to various demands such that said actual strobe signals are formed to provide versatile control pulses to said print head.

4. The apparatus according to claim 1, wherein said virtual strobe signals have the same number as or a different number from said actual strobe signals such that versatile combinations of said actual strobe signals transmitted to said input pin.

5. The apparatus according to claim 4, wherein said multiplexer performs a connection between said virtual strobe signals and said actual strobe signals to generate said versatile combinations of said actual strobe signals.

6. The apparatus according to claim 1, wherein said data buffer region is a first-in-first-out data buffer region to transmit said printing data with a stored sequence of said data.

7. A method for multichannel sequence transmission and control applied to a thermal transfer print head or a thermal print head comprising following steps:

a step of initial setting, wherein an external microcontroller controls a control unit via a bus interface to generate a TPH shift clock and a TPH latch signal needed by said print head;

a step of transmitting data, wherein a DMA generator transmits an assigned printing data to a data generator for being buffered and said printing data is moved to a latch register of said print head according to said TPH latch signal; and a step of heating said print head, wherein a plurality of heating units provided in said print head are started, a plurality of different virtual strobe signals and at least a multiplexer are provided by a strobe signal generator, the virtual strobe signals are combined to form different combinations of actual strobe signals sequentially, said different combinations of actual strobe signals are transmitted to said print head via at least an input pin, and said print head is heated to perform a printing operation of said assigned printing data until said actual strobe signals ending.

8. The method according to claim 7, wherein said step of transmitting data further comprises a process of a control unit automatically generating a TPH latch signal at an appropriate time duration after said printing data being transmitted to a data buffer region in said data generator to transmit said printing data in said data buffer region to said latch register.

9. The method according to claim 8, wherein said appropriate time duration is a time duration said print head being able to receive said latch signal and moving said printing data to said latch register.

10. The method according to claim 8, wherein said control unit automatically delays generation of said TPH latch signal for a next heating operation of said print head until a current heating operation ending.

11. The method according to claim 7, wherein said step of heating said print head further comprises a process of a signal period of each of said virtual strobe signals and a a time spacing between the respective virtual strobe signal being set up to allow said multiplexer combining said virtual strobe signals and outputting said actual strobe signals to said print head.

* * * * *